US007966979B2

(12) United States Patent
Olsen et al.

(10) Patent No.: US 7,966,979 B2
(45) Date of Patent: Jun. 28, 2011

(54) MOUNTING AND COOLING DEVICE FOR EMISSIONS SYSTEM ELECTRONICS

(75) Inventors: Paul Frederick Olsen, Chillicothe, IL (US); Jack Albert Merchant, Peoria, IL (US); Eric James Charles, Peoria, IL (US); Muthukumar Chandrasekaran Trichirapalli, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 336 days.

(21) Appl. No.: 12/320,424

(22) Filed: Jan. 26, 2009

(65) Prior Publication Data

US 2010/0186388 A1 Jul. 29, 2010

(51) Int. Cl.

| | |
|---|---|
| ***F01P 1/06*** | (2006.01) |
| *F01N 3/00* | (2006.01) |
| *F16M 11/00* | (2006.01) |
| *H05K 7/20* | (2006.01) |
| *F28F 7/00* | (2006.01) |

(52) U.S. Cl. ..... 123/41.31; 123/195 A; 123/195 E; 60/286; 248/200; 361/699; 165/80.4; 165/80.5; 165/104.33; 174/15.1

(58) Field of Classification Search ..... 361/698–702, 361/679.53; 165/80.4–80.5, 104.33; 257/714–716; 174/15.1, 252; 248/121–125.9, 200–316.8; 123/165 A, 41.31; 60/286
See application file for complete search history.

(56) References Cited

U.S. PATENT DOCUMENTS

| | | | | |
|---|---|---|---|---|
| 4,763,611 | A | 8/1988 | Kobayashi et al. | |
| 4,893,590 | A | 1/1990 | Kashimura et al. | |
| 5,605,042 | A | 2/1997 | Stutzenberger | |
| 5,947,188 | A * | 9/1999 | Nestvall | 165/41 |
| 6,279,603 | B1 | 8/2001 | Czarnik et al. | |
| 6,313,991 | B1 | 11/2001 | Nagashima et al. | |
| 6,396,692 | B1 * | 5/2002 | Farshi et al. | 361/690 |
| 6,539,708 | B1 | 4/2003 | Hofmann et al. | |
| 6,604,494 | B2 | 8/2003 | Skrzypchak et al. | |
| 6,639,798 | B1 | 10/2003 | Jeter et al. | |
| 6,745,823 | B2 | 6/2004 | Brost | |
| 6,814,303 | B2 | 11/2004 | Edgar et al. | |
| 6,834,634 | B2 * | 12/2004 | Lawrence | 123/195 C |
| 6,848,957 | B2 | 2/2005 | Yashiro et al. | |
| 6,871,699 | B1 * | 3/2005 | Boyd et al. | 165/80.4 |
| 6,982,873 | B2 | 1/2006 | Meyer et al. | |
| 7,324,342 | B2 | 1/2008 | Taylor et al. | |
| 7,810,466 | B2 * | 10/2010 | Preimesberger et al. | 123/195 A |
| 2004/0159290 | A1 * | 8/2004 | Skrzypchak et al. | 123/41.31 |
| 2006/0156712 | A1 | 7/2006 | Buhmann et al. | |
| 2007/0163765 | A1 | 7/2007 | Rondier et al. | |
| 2010/0186381 | A1 * | 7/2010 | Charles et al. | 60/282 |
| 2010/0187383 | A1 * | 7/2010 | Olsen et al. | 248/201 |

* cited by examiner

*Primary Examiner* — Zachary M Pape

(74) *Attorney, Agent, or Firm* — Finnegan, Henderson, Farabow, Garrett & Dunner LLP

(57) ABSTRACT

A cooling device for emissions system electronics is disclosed. The cooling device may have a mount for an exhaust treatment device. The mount may have a framework comprising a plurality of rigid members. The cooling device may also have a passageway located within at least one rigid member of the plurality of rigid members. The passageway may be configured to transmit a flow of coolant. The cooling device may further have a plate coupled to the at least one rigid member and at least one electronic device coupled to the plate. The at least one electronic device may be associated with the exhaust treatment device.

20 Claims, 6 Drawing Sheets

MOUNTING AND COOLING DEVICE FOR EMISSIONS SYSTEM ELECTRONICS

TECHNICAL FIELD

The present disclosure relates generally to a mounting device for emissions system components and, more particularly, to a mounting and cooling device for emissions system electronics.

BACKGROUND

Conventional diesel powered systems for engines, factories, and power plants produce emissions that contain a variety of pollutants. These pollutants may include, for example, particulate matter (e.g., soot), nitrogen oxides (NOx), and sulfur compounds. Due to heightened environmental concerns, engine exhaust emission standards have become increasingly stringent. In order to comply with emission standards, machine manufacturers have developed and implemented a variety of exhaust treatment components to reduce pollutants in exhaust gas prior to the exhaust gas being released into the atmosphere. The exhaust treatment components may include, for example, a diesel particulate filter, a selective catalytic reduction device, a diesel oxidation catalyst, a fuel-fired burner for regeneration of the diesel particulate filter, a muffler, and other similar components.

Frequently these exhaust treatment components, including their associated sensors and electronics, are mounted individually in an exhaust system within the available space using individual brackets. However, due to the increasing complexity and number of exhaust treatment components and the small amount of available space, mounting and interconnecting exhaust treatment components has proven difficult.

U.S. Patent Publication No. 2006/0156712 (the '712 publication) to Buhmann et al. discloses an exhaust gas treatment system for an internal combustion engine. The '712 publication discloses a basic housing and an add-on housing mounted thereon that is at least partially detachable. The basic housing contains at least one inlet pipe which can be connected to the exhaust system and leads into the basic housing. The basic housing also contains at least one outlet pipe which can be connected to the exhaust system and leads out of the basic housing. The basic housing further contains at least one SCR catalyst and at least one oxidizing catalytic converter. The add-on housing contains at least one particle separation device and at least one reducing agent feed mechanism.

Although the system of the '712 publication may have a detachable add-on housing, the '712 system may still be bulky and lack flexibility. Furthermore, accessing and maintaining the basic housing of the '712 system may be difficult. Additionally, locating several exhaust devices in a housing can create extremely high temperatures. The '712 system does not provide a method for cooling any electronics that may be associated with the '712 system, which could potentially lead to overheating and failure of the electronics.

The disclosed cooling device is directed to overcoming one or more of the problems set forth above.

SUMMARY OF THE DISCLOSURE

In one aspect, the present disclosure is directed to a cooling device for emissions system electronics. The cooling device may include a mount for an exhaust treatment device. The mount may include a framework comprising a plurality of rigid members. The cooling device may also include a passageway located within at least one rigid member of the plurality of rigid members. The passageway may be configured to transmit a flow of coolant. The cooling device may further include a plate coupled to the at least one rigid member and at least one electronic device coupled to the plate. The at least one electronic device may be associated with the exhaust treatment device.

In another aspect, the present disclosure is directed to a mounting device for an emissions system. The mounting device may include a first bracket and a second bracket. The mounting device may also include a first support surface in each of the first and the second brackets. The first support surface may be configured to support a first exhaust treatment device. The mounting device may further include a second support surface in each of the first and the second brackets. The second support surface may be configured to support a second exhaust treatment device. The mounting device may also include a framework including at least one tube. The at least one tube may be configured to transmit a flow of coolant. The mounting device may further include a plate coupled to the at least one tube and an electronic device coupled to the plate. The electronic device may be associated with at least one of the first exhaust treatment device and second exhaust treatment device.

In a further aspect, the present disclosure is directed to a cooling device for emissions system electronics. The cooling device may include a mount for an exhaust treatment device. The cooling device may also include a mounting plate connected to the mount. The cooling device may further include at least one electronic device coupled to the mounting plate. The at least one electronic device may be associated with the exhaust treatment device.

DETAILED DESCRIPTION

Figure 1:
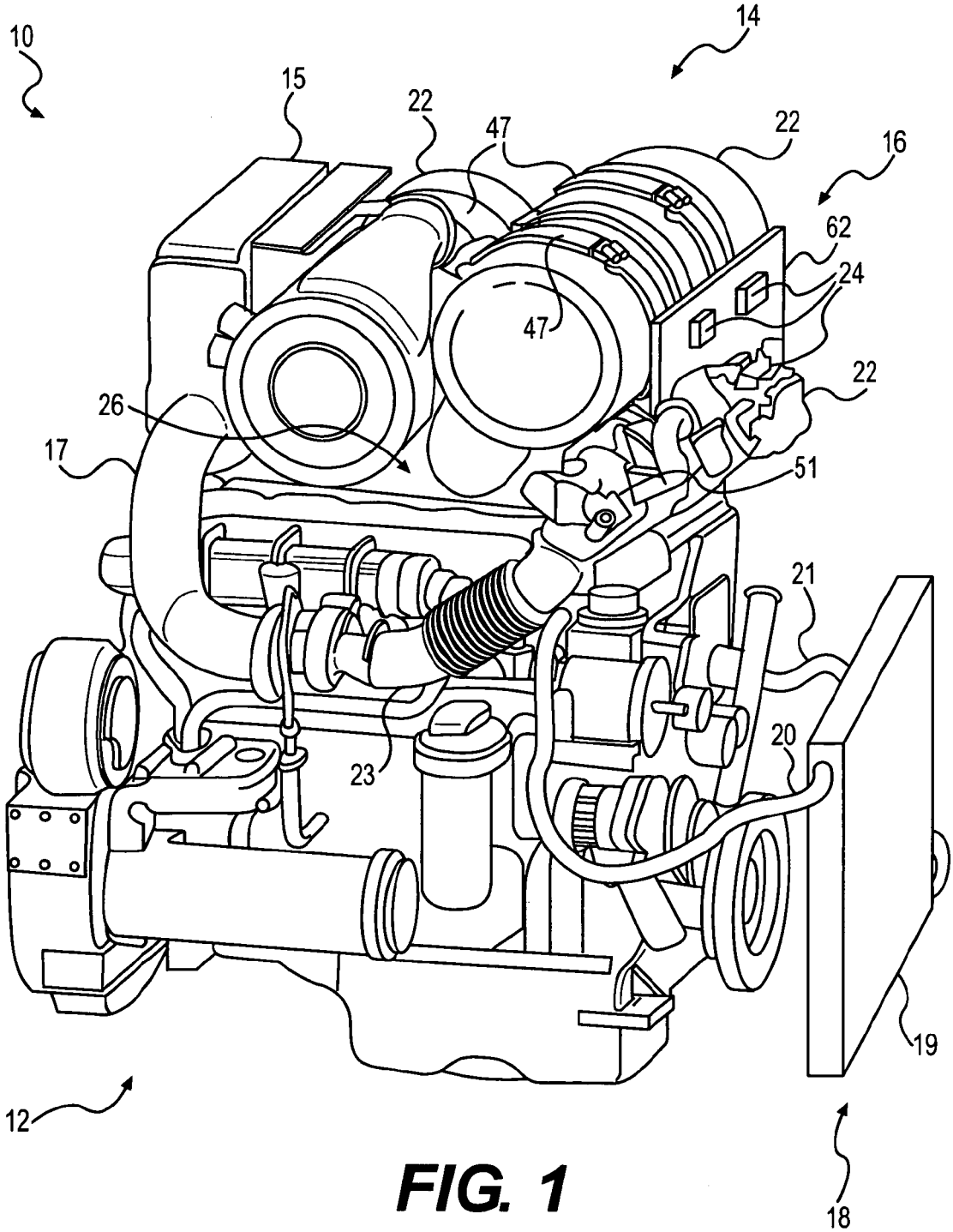
FIG. 1 is a diagrammatic illustration of an exemplary disclosed power system including an emissions control system.

FIG. 1 illustrates a diagrammatic representation of a power system 10, which may include a power source 12 and an exhaust system 14. Power source 12 may embody a combustion engine, such as, for example, a diesel engine, a gasoline engine, a gaseous fuel-powered engine (e.g., a natural gas engine), or any other type of combustion engine known to one skilled in the art. Power source 12 may have a plurality of combustion chambers (not shown) that convert potential chemical energy (usually in the form of a combustible gas) into useful mechanical work. It is also considered that power source 12 may embody a furnace or a similar device. Power source 12 may receive air from an air cleaner 15 which fluidly communicates with power source 12 via intake 17. Power source 12 may output a flow of exhaust via an exhaust conduit 23.

Power source 12 may include a cooling system 18 to dissipate heat from power source 12 and/or other components associated with power system 10. Cooling system 18 may help dissipate the heat from power source 12 by directing a coolant through power source 12. The heated coolant exiting power source 12 may be directed via an inlet passageway 20 to a heat exchanger 19. The cooled coolant may exit heat exchanger 19 via an outlet passageway 21 and be carried back to power source 12. Heat exchanger 19 may embody, for example, an oil cooler, a radiator, or any other type of heat exchanging device known in the art. The coolant may include water, a mixture of water and ethylene glycol (i.e. antifreeze), oil, or any other suitable coolant.

Exhaust system 14, including exhaust conduit 23, may direct exhaust from power source 12 to the atmosphere. Exhaust system 14 may include an emissions control system 16 configured to monitor, control, and/or modify exhaust emissions. Emissions control system 16 may include one or more exhaust treatment devices 22, electronics 24 associated with exhaust treatment devices 22, and a mount 26.

Exhaust treatment devices 22 may be devices configured to reduce emissions of harmful gasses, particulate matter, and/or noise emitted from power source 12. Each exhaust treatment device 22 may embody, for example, a diesel oxidation catalyst (DOC), a particulate filter (PF or DPF), a selective catalytic reduction (SCR) device, a lean NOx trap (LNT), a muffler, a regeneration device, a reductant mixing device, or any other exhaust treatment device known in the art. It is contemplated that each exhaust treatment device 22 may also comprise a combination of exhaust treatment devices, such as, for example, a combination of a DOC and a DPF; a combination of a catalyst and a DPF (i.e., a CDPF); a combination of a DOC, a DPF, and an SCR; or other combinations known in the art.

Electronics 24 may be configured to monitor and/or control operation of exhaust treatment devices 22. Electronics 24 may include one or more electronic devices, such as, for example, sensors, microprocessors, power supply circuitry, signal conditioning circuitry, actuator driving circuitry, solenoids, relays, electronic valves, coils, and/or other types of electronics and circuitry known in the art. For example, electronics 24 may include a microprocessor and other electronic hardware configured to control injection of a reductant into one of exhaust treatment devices 22 (e.g., reductant for SCR or LNT). Electronics 24 may also include a microprocessor and other electronic hardware configured to control a regeneration process for one of exhaust treatment devices 22 (e.g., regeneration of DPF).

Figure 2:
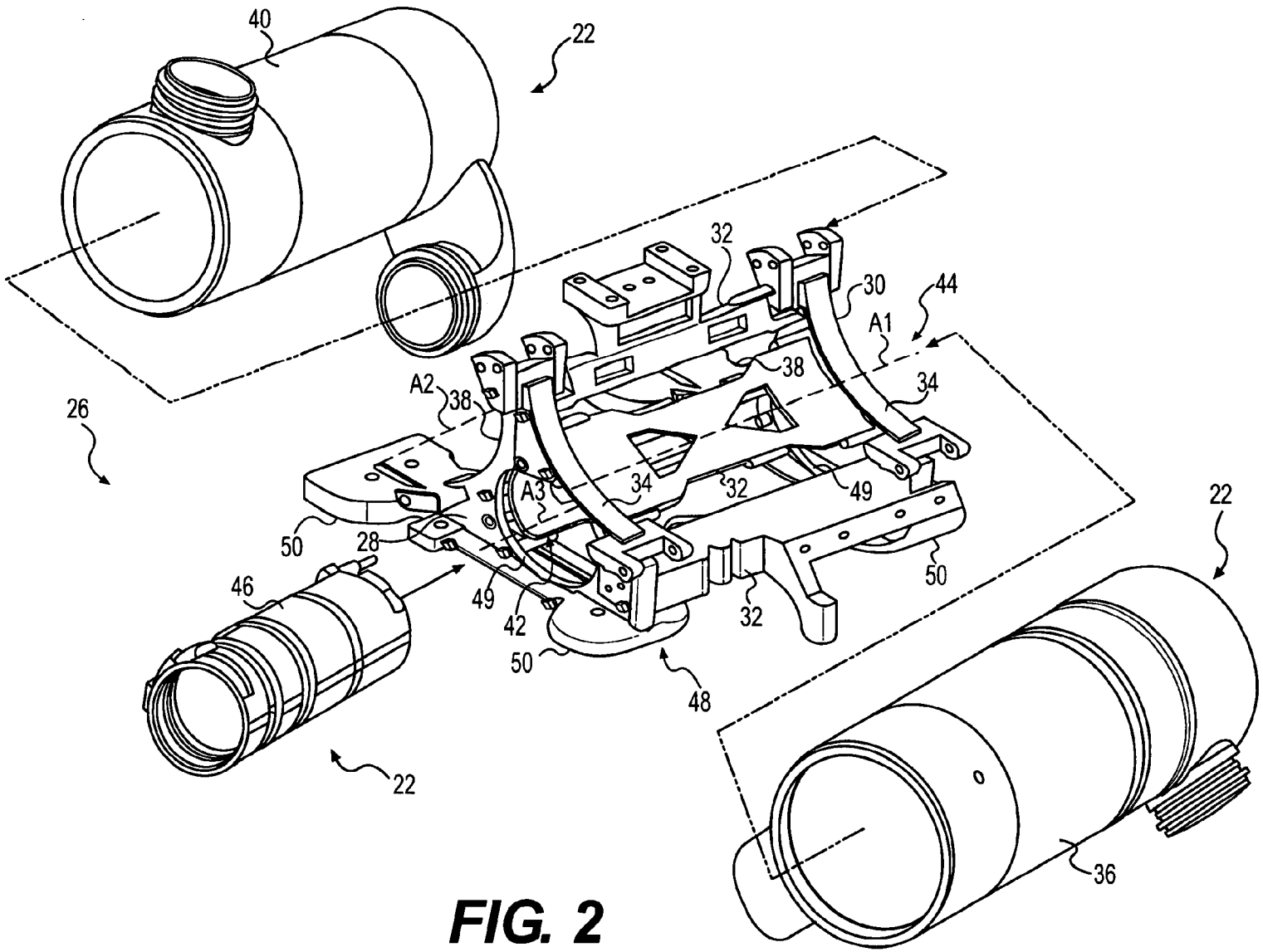
FIG. 2 is a diagrammatic illustration of an exemplary mount that may be used with the emissions control system of FIG. 1.

As shown in FIG. 2, mount 26 may be a device configured to support multiple exhaust treatment devices 22 using a single structure. Specifically, mount 26 may be configured to secure exhaust treatment devices 22 in a compact configuration. Mount 26 may include a first bracket 28 and a second bracket 30. First bracket 28 and second bracket 30 may be oriented parallel but spaced apart from each other. First bracket 28 may be coupled to second bracket 30 using one or more rigid cross members 32. Cross members 32 may attach to first and second brackets 28 and 30 via mechanical fasteners (e.g., bolts, screws, rivets, etc.), welding, brazing, or any other joining process known in the art. Alternatively, first bracket 28, second bracket 30, and cross members 32 may be formed using a single casting.

Each of first and second brackets 28 and 30 may include a first support surface 34. First support surface 34 of first bracket 28 and first support surface 34 of second bracket 30 may be configured to support each end of a first exhaust treatment device 36. Each of first and second brackets 28 and 30 may also include a second support surface 38. Second support surface 38 of first bracket 28 and second support surface 38 of second bracket 30 may be configured to support each end of a second exhaust treatment device 40. In addition to connecting first and second brackets 28 and 30, one or more of cross members 32 may be configured to support a middle portion of first exhaust treatment device 36 and/or second exhaust treatment device 40.

It is contemplated that a geometry of first support surface 34 may be shaped to match an outer geometry of first exhaust treatment device 36 and a geometry of second support surface 38 may be shaped to match an outer geometry of second exhaust treatment device 40. For example, when first and second exhaust treatment devices 36 and 40 are shaped as canisters, first and second support surfaces 34 and 38 may have generally arcuate surfaces with substantially the same radii of curvature as first and second exhaust treatment devices 36 and 40, respectively. One or more bands 47 (see FIG. 1) may pass over exhaust treatment devices 22 and secure exhaust treatment devices 22 to mount 26.

Mount 26 may also include a first aperture 42 in first bracket 28 and a second aperture 44 in second bracket 30. Each of first and second apertures 42 and 44 may include a third support surface 49. Third support surface 49 of first aperture 42 and third support surface 49 of second aperture 44 may be configured to support, for example, each end of a third exhaust treatment device 46. In an exemplary embodiment of emissions control system 16, first exhaust treatment device 36 may embody a diesel particulate filter, second exhaust treatment device 40 may embody a muffler, and third exhaust treatment device 46 may embody a tube for injection and mixing of reductant.

Mount 26 may also support or house a fourth exhaust treatment device 51 (see FIG. 1). Fourth exhaust treatment device 51 may embody, for example, a regeneration device, such as a fuel fired burner. Fourth exhaust treatment device 51 may be configured to inject fuel and ignite the injected fuel in order to heat the exhaust flow received from power source 12 via exhaust conduit 23. As shown in one embodiment in FIG. 3, fourth exhaust treatment device 51 may be mounted in a mounting location 53.

Returning to FIG. 2, it should be noted that first support surfaces 34, second support surfaces 38, and third support surfaces 49 may be located to allow for first, second, and third exhaust treatment devices, 36, 40, and 46, respectively, to be positioned in a compact, side-by-side, parallel orientation. For example, an axis A1 of first support surfaces 34, an axis A2 of second support surfaces 38, and an axis A3 of third support surfaces 49 may all be parallel. It is contemplated that mount 26 may be configured to allow for easy access and removal of each exhaust treatment device 22.

Mount 26 may include a base portion 48 with one or more footings 50. Specifically, each of first and second brackets 28 and 30 may include, for example, at least two footings 50. Each footing 50 may be configured to mount to power source 12 or another frame or structure (not shown).

Figure 3:
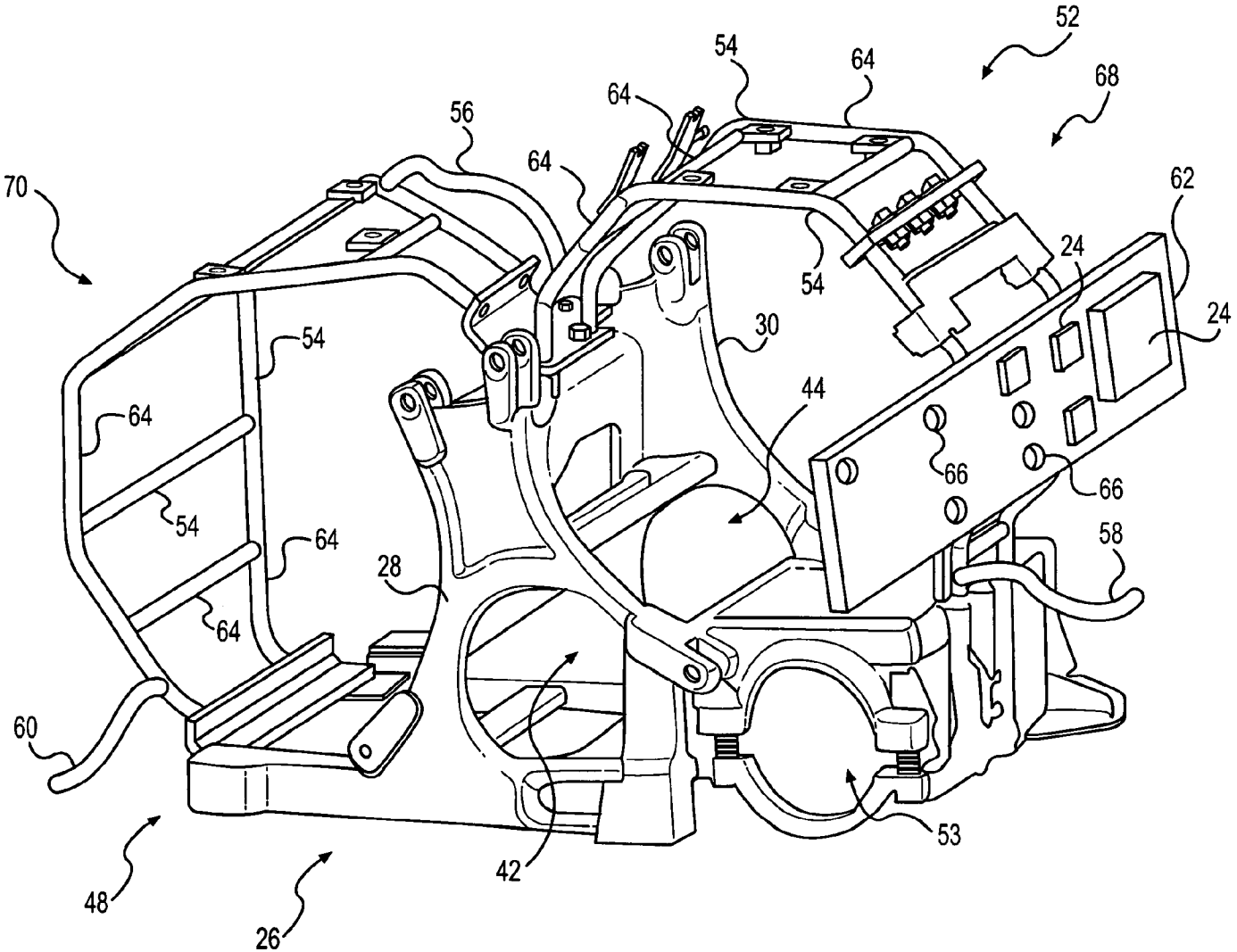
FIG. 3 is a diagrammatic illustration of an exemplary mount and framework that may be used with the emissions control system of FIG. 1.

As shown in FIG. 3, mount 26 may include a framework 52 which is coupled to base portion 48, first bracket 28, and/or second bracket 30. Framework 52 may provide a structure to which electronics 24 and other components of emissions control system 16 may be mounted.

Framework 52 may be composed of a plurality of rigid members 54. Rigid members 54 may be composed of any appropriate material known in the art, such as, for example, steel, aluminum, copper, or any other appropriate material or combination of materials. Rigid members 54 may include at least two tubes 64. Each tube 64 may include a passageway for conveying fluid. An inlet 58 of at least one tube passageway may be fluidly coupled to outlet passageway 21 of cooling system 18. An outlet 60 of at least one tube passageway may be fluidly coupled to an inlet passageway 20 of cooling system 18. One or more tubes 64 may at least partially encircle exhaust treatment devices 22. Tubes 64, however, may not directly contact exhaust treatment devices 22. In one embodiment, framework 52 may be comprised of two sections of tubes 64, a first section 68 at least partially surrounding first exhaust treatment device 36 and a second section 70 at least partially surrounding second exhaust treatment device 40. The first and second sections 68 and 70 of tubes 64 may be fluidly connected by a connecting conduit 56.

Framework 52 may also include a mounting plate 62. Mounting plate 62 may be a structure (e.g., a plate) to which electronics 24 may be mounted. Mounting plate 62 may include a plurality of mounting holes 66 to facilitate mounting of electronics 24. Mounting plate 62 may also include connectors or supports 71 (see FIG. 4) to allow for mounting of wiring and/or conduits 72. Wiring and/or conduits 72 may be associated with fourth exhaust treatment device 51. For example, wiring and/or conduits 72 may provide fuel and air utilized in a regeneration process. Mounting plate 62 may be composed of a rigid thermally conductive material, such as, for example, steel, aluminum, iron, or any other thermally conductive material known in the art.

Mounting plate 62 may directly attach or couple to one or more tubes 64 such that thermal energy transfers between mounting plate 62 (and electronics 24) and the coolant in the tube passageways. For example, mounting plate 62 may attach to tubes 64 via welding, mechanical fastening, or brazing. It is contemplated that tubes 64 may be thermally insulated along the length of tubes 64 except for the location where mounting plate 62 attaches to tubes 64. In one embodiment, tubes 64 may have an external reflective layer to prevent radiation heat transfer. Tubes 64 may also include an insulation layer to prevent conductive and/or convective heat transfer. It is also contemplated that framework 52 may include a plurality of mounting plates 62, all configured to provide a mounting location for electronics 24. Alternatively, in some embodiments, the insulation and/or external reflective layer may be omitted, thus allowing tubes 64 to cool or otherwise control the temperature of additional components besides electronics 24.

Figure 4:
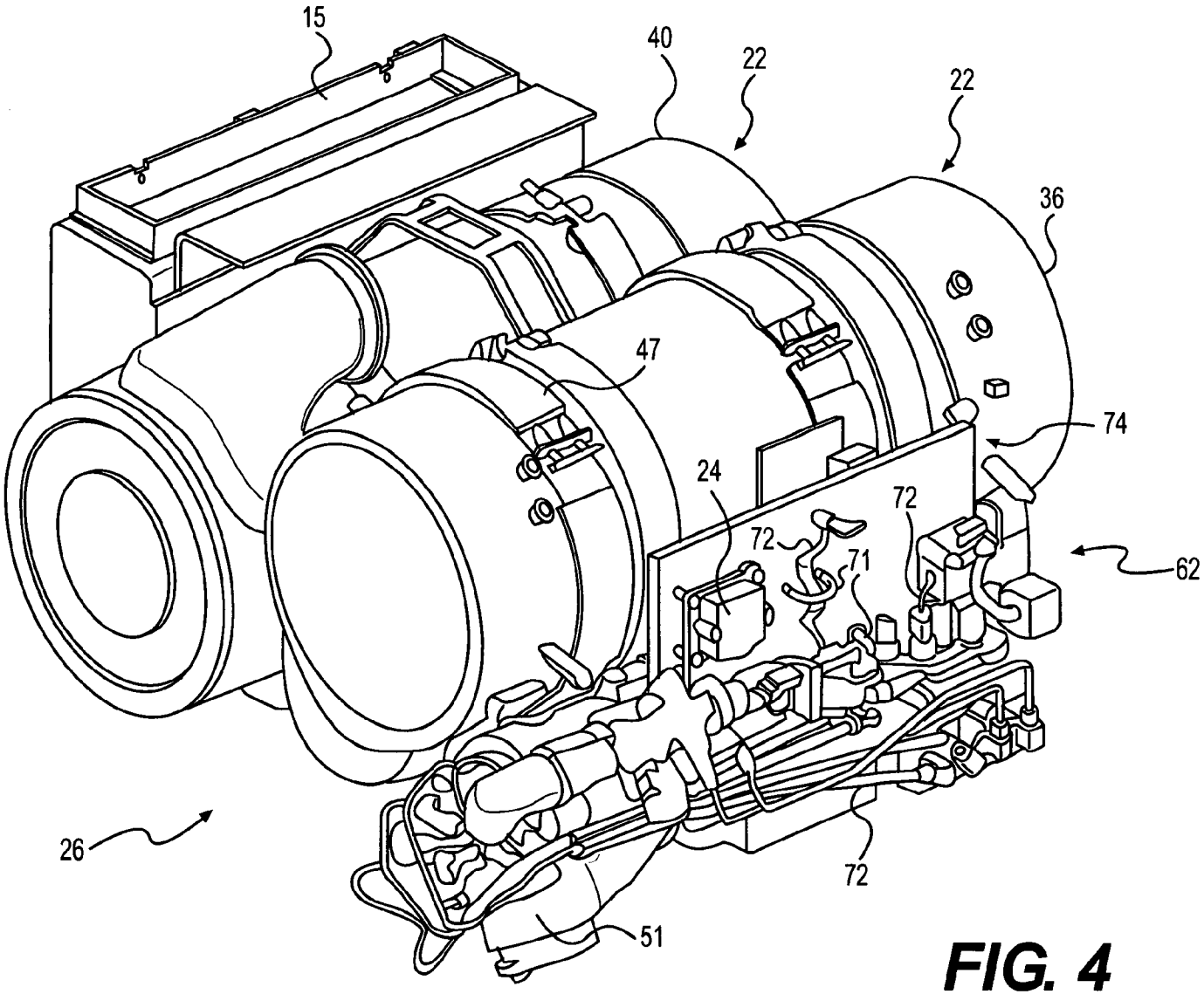
FIG. 4 is a diagrammatic illustration of an exemplary emissions control system with a mounting plate.

As shown in FIG. 4, framework 52 may be omitted and mounting plate 62 may be connected directly to or formed integrally with mount 26. Mounting plate 62 may be a structure that provides a thermal barrier between electronics 24 and exhaust treatment devices 22 (e.g., blocks thermal radiation before it reaches electronics 24). It is contemplated that an air gap 74 may exist between mounting plate 62 and first exhaust treatment device 36. Air gap 74 may at least partially thermally isolate mounting plate 62 from exhaust treatment devices 22. Air gap 74 may also allow for a flow of air to pass on both sides of mounting plate 62 in order to enhance cooling of mounting plate 62 and electronics 24. It is also contemplated that in some embodiments mounting plate 62 may include an enclosure (not shown) over electronics 24.

INDUSTRIAL APPLICABILITY

The disclosed mount may be applicable to any power system. The disclosed mount may provide a compact structure for mounting exhaust treatment devices in a power system. The disclosed mount may also provide for cooling of electronic devices associated with the exhaust treatment devices. Operation of the disclosed power system will now be described.

Figure 5:
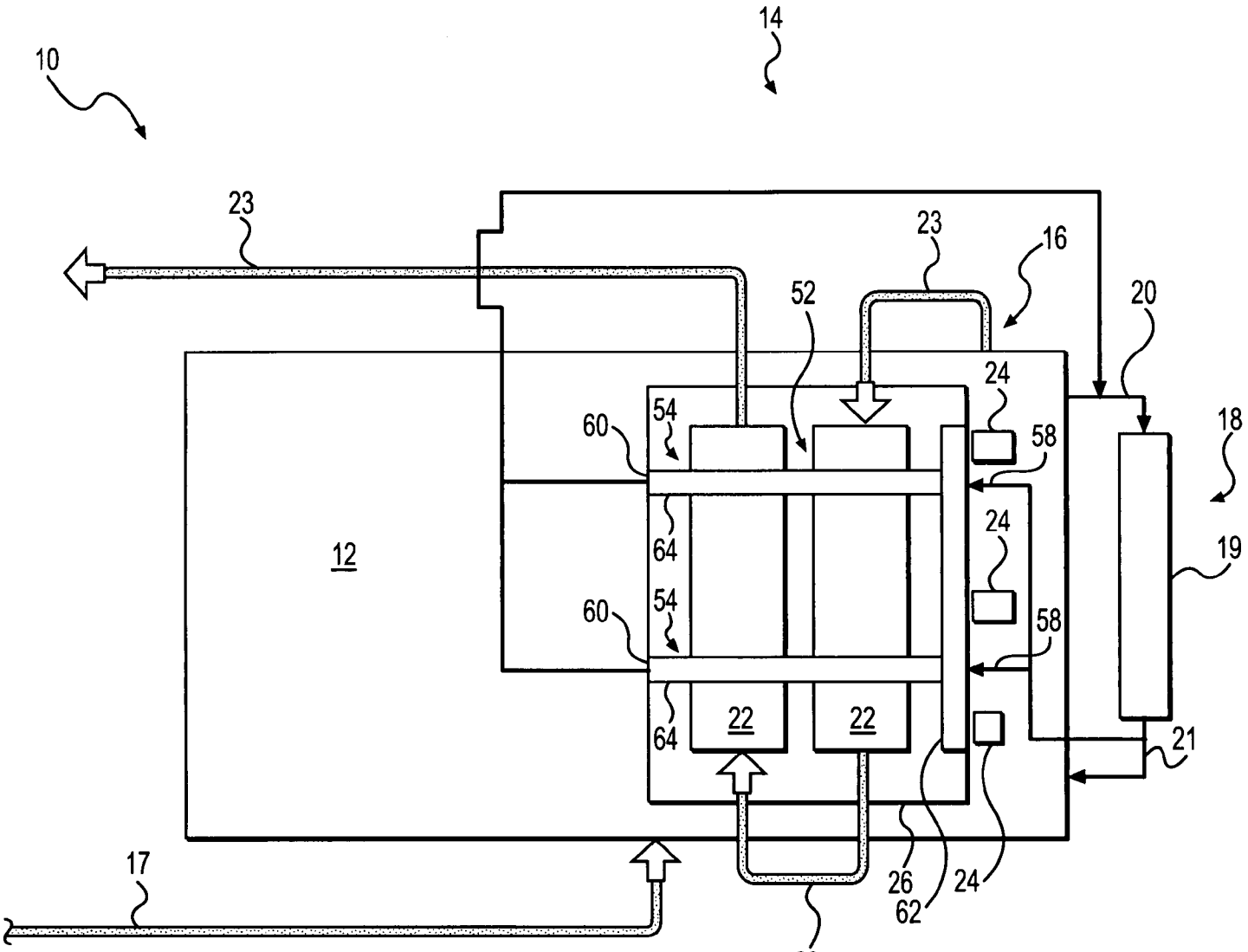
FIG. 5 is a schematic illustration of an exemplary disclosed power system including an emissions control system.

Referring to FIG. 5, air may be drawn into power source 12 for combustion via intake 17. Fuel and air may be combusted to produce a mechanical work output and an exhaust flow. The exhaust flow may contain a complex mixture of air pollutants composed of gases and particulate matter. The exhaust flow may be directed from power source 12 via exhaust conduit 23 to exhaust treatment devices 22. After passing through exhaust treatment devices 22, the exhaust flow may be released into the atmosphere.

During operation of power source 12, coolant may be directed into power source 12. While passing through power source 12, the thermal energy from power source 12 may be transferred to the coolant, thus raising the coolant's temperature. The heated coolant exiting power source 12 may be directed via an inlet passageway 20 to a heat exchanger 19. While passing through heat exchanger 19, the coolant may transfer its thermal energy to a lower temperature fluid, such as, for example, ambient air. The cooled coolant may then exit heat exchanger 19 via an outlet passageway 21 (on a downstream side of heat exchanger 19), and at least a potion of the coolant may be carried back to power source 12. Another portion of the coolant may be directed via inlet 58 to passageways of mount 26. While the coolant flows through passageways, heat may be transferred between mounting plate 62 and the coolant in passageways. This transfer of thermal energy may help maintain electronics 24 coupled to mounting plate 62 within a desired operating temperature range. After passing through passageways, the coolant may return via outlet 60 back to inlet passageway 20 of heat exchanger 19.

Figure 6:
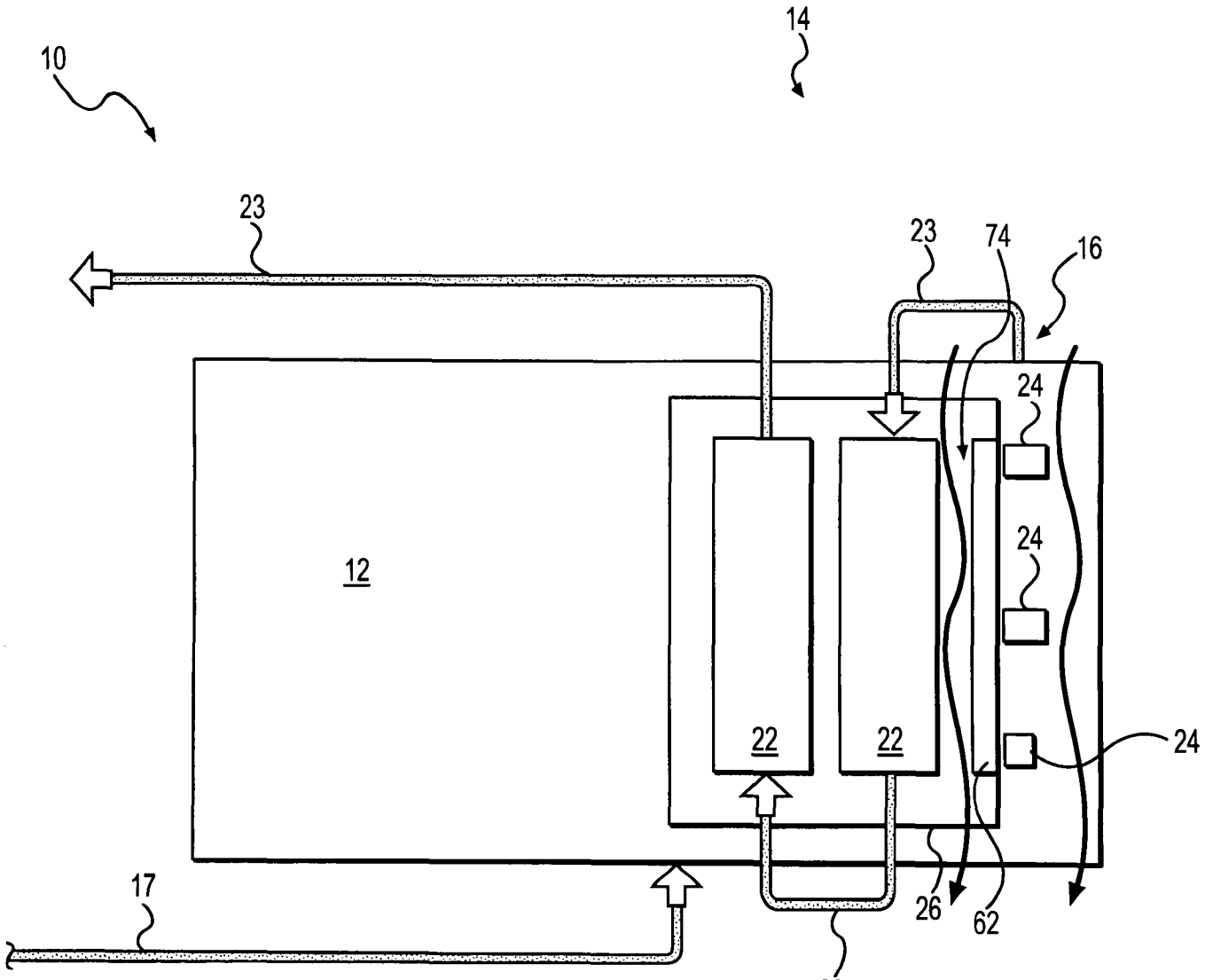
FIG. 6 is another schematic illustration of an exemplary disclosed power system including an emissions control system.

In the embodiment shown in FIG. 6, framework 52 may be omitted and mounting plate 62 may attach directly to mount 26. Thermal energy within mounting plate 62 and/or electronics 24 may be transferred to ambient air that surrounds or flows past mounting plate 62. As the thermal energy is transferred to the ambient air, a temperature of electronics 24 may be reduced or maintained within a desired range.

The disclosed mount may be applicable to any exhaust system. The disclosed mount may provide a compact structure for mounting exhaust treatment devices in a power system, thus preserving space for other power system components. The disclosed mount may also allow for easy switching and maintenance of the exhaust treatment devices used with the disclosed mount. Additionally, the disclosed mount may help maintain electronic devices associated with the exhaust treatment devices within a desired temperature range, thus preventing malfunctions and potential failure of the electronic devices. The mounting plate associated with the disclosed mount may provide a thermal barrier between electronic devices mounted thereon and other exhaust treatment devices in the exhaust system.

It will be apparent to those skilled in the art that various modifications and variations can be made to the disclosed mount. Other embodiments will be apparent to those skilled in the art from consideration of the specification and practice of the disclosed mount. It is intended that the specification and examples be considered as exemplary only, with a true scope being indicated by the following claims.

What is claimed is:

1. A cooling device for emissions system electronics, comprising:

a mount for an exhaust treatment device, the mount including a framework comprising a plurality of rigid members;

a passageway located within at least one rigid member of the plurality of rigid members, the passageway being configured to transmit a flow of coolant;

a plate coupled to the at least one rigid member; and at least one electronic device coupled to the plate, the at least one electronic device being associated with the exhaust treatment device.

2. The cooling device of claim 1, wherein the at least one rigid member is thermally insulated along a length of the at least one rigid member except for a location where the plate couples to the at least one rigid member.

3. The cooling device of claim 1, wherein an inlet of the passageway is fluidly communicated with a fluid outlet of a heat exchanger.

4. The cooling device of claim 1, wherein at least two rigid members of the plurality of rigid members contact the plate but do not contact the exhaust treatment device, the at least two rigid members having passageways configured to transmit the flow of coolant.

5. The cooling device of claim 1, wherein the at least one electronic device includes at least one microprocessor.

6. The cooling device of claim 1, wherein the mount further includes:

a first bracket;

a second bracket;

a first support surface on each of the first and the second brackets, the first support surface of the first bracket and the first support surface of the second bracket being configured to support a first exhaust treatment device; and a second support surface on each of the first and the second brackets, the second support surface of the first bracket and the second support surface of the second bracket being configured to support a second exhaust treatment device.

7. The cooling device of claim 6, wherein the mount further includes at least one cross member, the at least one cross member coupling the first bracket to the second bracket.

8. The cooling device of claim 7, further including a first aperture in the first bracket and a second aperture in the second bracket, the first and second apertures including a third support surface configured to support a third exhaust treatment device.

9. The cooling device of claim 8, wherein the first and second support surfaces are arcuate in shape.

10. The cooling device of claim 9, wherein an axis of the first support surface, an axis of the second support surface, and an axis of the first and second apertures are all substantially parallel.

11. The cooling device of claim 10, wherein the first exhaust treatment device, the second exhaust treatment device, and the third exhaust treatment device each embody at least one of a diesel oxidation catalyst, a particulate filter, a selective catalytic reduction device, a lean NOx trap, a muffler, a regeneration device, or a reductant mixing device.

12. A mounting device for an emissions system, comprising:

a first bracket;

a second bracket;

a first support surface on each of the first and the second brackets, the first support surface being configured to support a first exhaust treatment device;

a second support surface on each of the first and the second brackets, the second support surface being configured to support a second exhaust treatment device;

a framework including at least one tube, the at least one tube being configured to transmit a flow of coolant;

a plate coupled to the at least one tube; and an electronic device coupled to the plate, the electronic device being associated with at least one of the first exhaust treatment device and second exhaust treatment device.

13. The mounting device of claim 12, wherein the at least one tube is a rigid tube composed of a thermally conductive material.

14. The mounting device of claim 13, wherein the at least one tube at least partially encircles at least one of the first exhaust treatment device and the second exhaust treatment device.

15. The mounting device of claim 14, wherein the at least one tube is thermally insulated along a length of the at least one tube except for a location where the plate couples to the at least one tube.

16. The mounting device of claim 12, wherein an inlet of the at least one tube is fluidly communicated with a fluid outlet of a heat exchanger.

17. The mounting device of claim 12, wherein the electronic device is a microprocessor.

18. The mounting device of claim 12, further including a plurality of cross members, the plurality of cross members coupling the first bracket to the second bracket.

19. The mounting device of claim 12, further including a first aperture in the first bracket and a second aperture in the second bracket, the first and second apertures including a third support surface configured to support a third exhaust treatment device.

20. A power system, comprising:

a power source;

a heat exchanger configured to transmit coolant through the power source; and a mount for at least one exhaust treatment device, the mount including:

at least one tube, wherein an inlet of the at least one tube is fluidly communicated with a downstream side of the heat exchanger;

a plate coupled to the at least one tube; and at least one electronic device coupled to the plate, the at least one electronic device being associated with the at least one exhaust treatment device.

* * * * *